US006935382B2

(12) United States Patent
Buckley

(10) Patent No.: US 6,935,382 B2
(45) Date of Patent: Aug. 30, 2005

(54) EXERCISE RUG WITH CONTOURS

(76) Inventor: Christine Buckley, 610 Pier Ave., Unit A, Santa Monica, CA (US) 90405

( * ) Notice: Subject to any disclaimer, the term of this patent is extended or adjusted under 35 U.S.C. 154(b) by 0 days.

(21) Appl. No.: 10/626,311

(22) Filed: Jul. 24, 2003

(65) Prior Publication Data

US 2004/0266295 A1 Dec. 30, 2004

Related U.S. Application Data

(60) Provisional application No. 60/482,542, filed on Jun. 25, 2003.

(51) Int. Cl.[7] ..... D03D 27/00

(52) U.S. Cl. ..... 139/391; 139/392; 139/393; 139/399; 139/400; 139/401

(58) Field of Search ..... 139/391, 392, 139/393, 399, 400, 401

(56) References Cited

U.S. PATENT DOCUMENTS 1,749,551 A * 3/1930 Stroud ..... 139/405
1,797,058 A * 3/1931 Gero ..... 139/401
1,846,751 A * 2/1932 Patterson ..... 139/396
1,859,922 A * 5/1932 Holland ..... 428/88
1,861,389 A * 5/1932 Grosjean ..... 4/587
2,090,462 A * 8/1937 Shuttleworth ..... 139/394
2,161,799 A * 6/1939 Sastberg ..... 139/391
2,254,830 A * 9/1941 Schloss ..... 4/582
2,430,559 A * 11/1947 Dacey ..... 139/403
2,607,042 A * 8/1952 Schloss ..... 112/410
2,820,454 A * 1/1958 Wright ..... 601/28
2,997,074 A * 8/1961 Law ..... 139/396
3,030,691 A * 4/1962 Law ..... 428/89
3,616,134 A * 10/1971 Palenske ..... 428/110
3,616,135 A * 10/1971 Tesainer et al. ..... 428/88
3,735,988 A * 5/1973 Palmer et al. ..... 473/162
4,421,110 A 12/1983 DeLisle
5,115,527 A 5/1992 Medley
5,500,267 A * 3/1996 Canning ..... 428/68
5,551,934 A 9/1996 Binette
5,652,038 A * 7/1997 Geren ..... 428/92
6,062,930 A 5/2000 Smith
6,367,398 B1 * 4/2002 Landau ..... 112/475.08
6,372,323 B1 * 4/2002 Kobe et al. ..... 428/119
6,468,621 B1 * 10/2002 Landau ..... 428/89
6,610,382 B1 * 8/2003 Kobe et al. ..... 428/119
6,666,234 B2 * 12/2003 Hamby et al. ..... 139/396

* cited by examiner

*Primary Examiner*—John J. Calvert
*Assistant Examiner*—Robert H. Muromoto, Jr.
(74) *Attorney, Agent, or Firm*—Knoble Yoshida & Dunleavy LLC

(57) ABSTRACT

A woven exercise rug having contours on the exercise surface for the purpose of reducing the chance of a user slipping during exercise is disclosed. The woven characteristic of the exercise rug provides for some moisture absorption and the contours provide additional gripping for the user of the rug to help reduce the chance of slipping due to moisture accumulation on the rug, due, for example, to perspiration. The contours of the rug may be provided by supplementary wefts or warps in the weave of the rug which are not required for the structural stability of the rug.

16 Claims, 3 Drawing Sheets

EXERCISE RUG WITH CONTOURS

CROSS-REFERENCE TO RELATED APPLICATIONS

This application claims the benefit under 35 U.S.C. § 119(e) of U.S. provisional application No. 60/482,542, filed on Jun. 25, 2003.

BACKGROUND OF THE INVENTION

1. Field of the Invention

The present invention relates to exercise rugs, and more particularly to exercise rugs used in the practice of hatha yoga, pilates, and other forms of exercise that traditionally take place on exercise mats. More particularly, the invention provides an exercise rug that will help prevent slipping once the user begins to perspire.

2. Description of the Prior Art

The practice of mat-based exercise, such as hatha yoga and pilates, has become extremely popular in recent years. Types of hatha yoga mat-based exercise include, but are not limited to, bikram yoga, ashtanga yoga, power yoga, vinyasa flow yoga and hot yoga.

Traditionally, such mat-based exercise takes place barefoot on a foam exercise mat. However, a common complaint is that when the user begins to sweat, the exercise mat becomes slippery.

An existing solution to this problem is the use of an exercise rug, often called a mysore rug, yoga rug or an ashtanga rug, which is either placed on top of the exercise mat, or used in lieu of an exercise mat. The exercise rug absorbs sweat, therefore decreasing the slipperiness of the exercise surface. The most common exercise rug is usually woven in a loom using a balanced weave (i.e., when both the warp and weft threads are equal in number per centimeter). Although exercise rugs absorb some sweat and condensation, there still exists the problem of slippage on the wet surface, which slippage makes a workout less effective and increases the risk of injury.

SUMMARY OF THE INVENTION

The present invention relates, in a first aspect, to a woven exercise rug including contours woven into the rug in order to reduce the likelihood of slipping while exercising on the exercise rug of the present invention. The contours reduce slippage by contacting various parts of the user's hands and feet and serving as a gripping surface to hold the user's hands and feet in place on the exercise rug even if the exercise rug has become wet, due, for example, to perspiration.

Thus, it is an objective of certain embodiments of the invention to provide an improved exercise rug design which increases the stability and efficient movement of an user by reducing slipping due to moisture on the exercise rug.

It is another objective of certain embodiments of the invention to provide a novel weave of an exercise rug in order to create a series of contours on the exercise rug, therefore reducing slipping when an user using the rug perspires, by providing grip and/or resistance against slipping.

These and other objectives of the invention will become apparent from a detailed description of the invention, which follows taken in conjunction with the accompanying drawing.

DETAILED DESCRIPTION OF THE PREFERRED EMBODIMENTS

In one aspect, the present invention relates to an exercise rug 10, which can be used by a user for various activities. Preferably, the user exercises on the exercise rug 10 of the invention. The practice of mat-based exercise, such as hatha yoga and pilates, has become extremely popular in recent years. Types of hatha yoga mat-based exercise include, but are not limited to, bikram yoga, ashtanga yoga, power yoga, vinyasa flow yoga and hot yoga. The exercise rug 10 of the present invention can be used in these types of mat-based exercise, as well as for other types of physical exercise such as aerobics, dancing, physical training, etc.

The exercise rug 10 of the present invention is woven in order to provide some absorption of moisture into the exercise rug 10. The exercise rug 10 can be made by any suitable, conventional weaving process known to persons skilled in the art.

Figure 1:
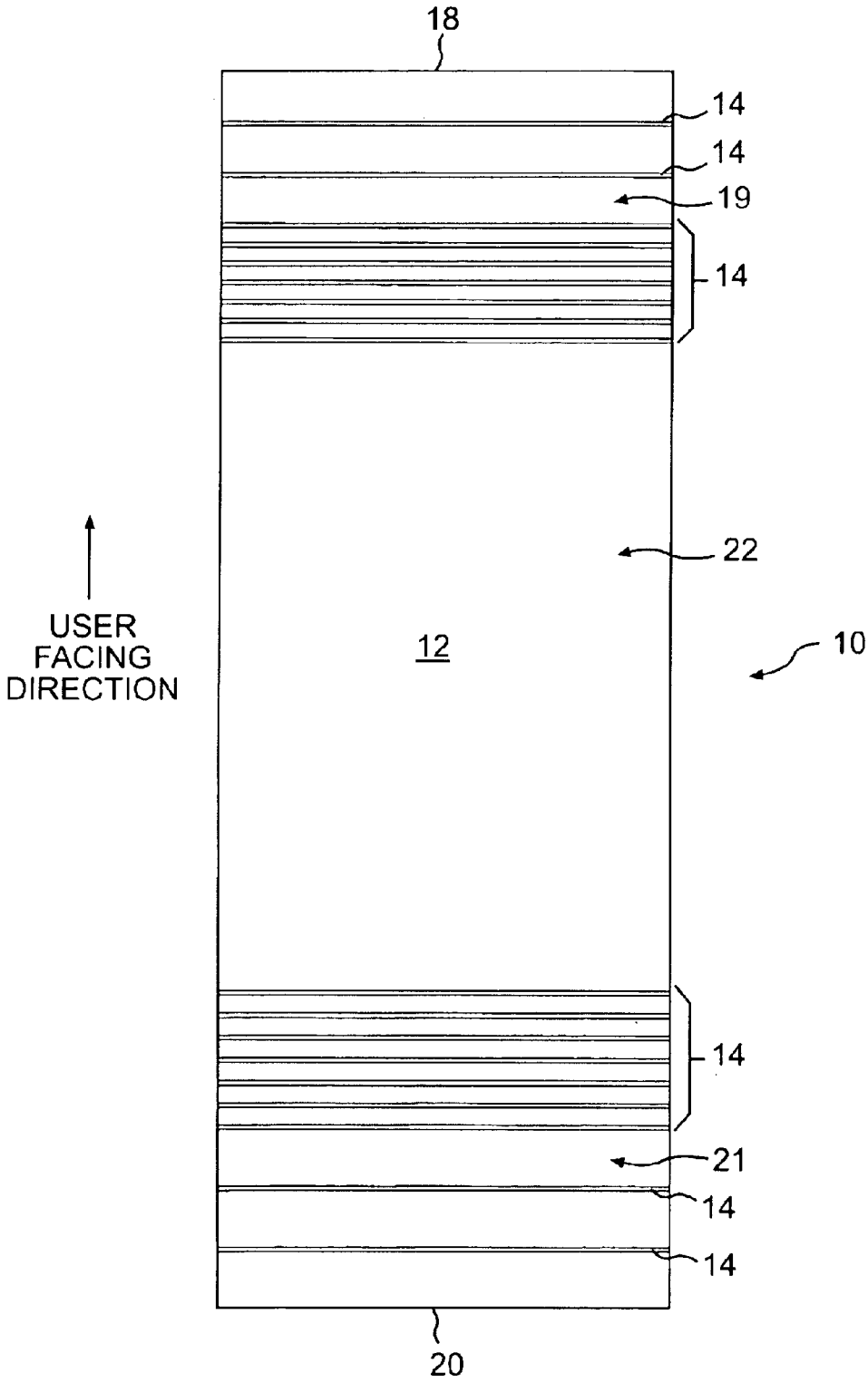
FIG. 1 is a top view of a preferred embodiment of an exercise rug in accordance with the present invention.

The exercise rug 10 of the present invention includes contours, such as the ridges 14 shown in FIG. 1, on the exercise surface 12 of the exercise rug 10. The contours reduce slipping by touching various parts of the user's hands and feet and serving as a grip to hold the user's hands and/or feet in place on the exercise rug when the user has been perspiring. Various forms of contours can be employed for this purpose. For example, instead of the ridges 14, other contours such as indentations in the exercise surface 12, web or dot patterns of contours which protrude relative to a non-contoured portion of the exercise surface, and/or combinations of two or more of these different types of contours can be employed. The contours should be of sufficient size to provide a user of the exercise rug 10 with an improved grip on the contoured portion of the exercise surface 12, as compared to the user's grip on a non-contoured exercise surface of a woven exercise rug.

In the context of the present application, the term, "contour" requires the presence of a portion of the rug that protrudes relative to a non-contoured portion of the exercise surface of the rug, a portion of the rug that is indented relative to a non-contoured portion of the exercise surface of the rug, or a portion of the rug that either protrudes relative to a non-contoured portion of the exercise surface or is indented relative to a non-contoured portion of the exercise surface. Preferably, the contours do not form a structurally necessary portion of the rug.

As an example, for a rug that is about ⅛ inch thick, the contours may protrude approximately ⅛ inch above the exercise surface of the rug or be indented up to about 1/16 inch into the exercise surface of the rug. Neither the precise height nor the depth of the contours, nor the spacing of the contours are critical to the function of the rug. Rather, the height or depth of the contours must be sufficient to provide a traction surface and the spacing of the contours can be in any form, and the contours can even be formed to provide decoration to the exercise rug.

The exercise rug 10 shown in FIG. 1, is generally rectangular in shape to provide the desired exercise surface 12 while helping to minimize the size of the exercise rug 10. Thus, in use, the user will orient the exercise rug 10 with the longer dimension facing in the direction of the user so that the user can kneel and/or lay down with their whole body still on the exercise surface 12. Other suitable shapes such as oval, elliptical, polygonal, round, etc. can also be employed, and the exercise rug 10 of the present invention is not limited to a particular shape.

Advantageously, the contours of the rug 10 are oriented substantially perpendicular to the longer dimension of the rug 10 since generally the longer dimension of the rug 10 corresponds to the direction that the user will face when using the exercise rug 10, as discussed above. For example, as shown in FIG. 1, the ridges 14 are oriented substantially perpendicular to the direction that the user will face. The ridges 14 reduce slipping by contact various parts of the user's hands and feet and serving as a grip to hold the user's hands and/or feet in place on the exercise rug 10 when the user has been perspiring. Also, the user may position his or her hands and feet so that fingers and/or toes are placed against the ridges 14 to provide further resistance against slipping or sliding on the exercise rug 10.

In a preferred form of the exercise rug 10 of the present invention, supplementary wefts (i.e. wefts that are not essential to the structural integrity of the rug, but are added to create a textured effect) are added to a rug to create a series of ridges 14 that run the width of the rug 10 as shown in FIG. 1. More preferably, such supplementary wefts are added to a conventional, balanced weave rug to provide contours on the exercise surface 12 of the rug 10, thereby creating a textured effect as shown in FIG. 1. The contours may also be provided by supplementary warps or a combination of supplementary wefts and supplementary warps, depending primarily on the desired geometry of the contours.

The exercise rug 10 of the present invention may be used in a variety of different ways. For example, the exercise rug 10 may be placed on top of a conventional exercise mat or may be used in place of a conventional exercise mat or yoga rug. The exercise rug of the present invention promotes physical stability during mat-based exercise. In an alternative embodiment, the exercise rug 10 includes additional structure on the surface opposite the exercise surface 12 for holding the exercise rug 10 in place on the ground, floor or on an exercise mat. Such additional structure may be any conventional means known for this purpose, such as a layer of rubber or other resilient material, suction cups, fasteners such as Velcro®, or other suitable means.

In a more preferred embodiment, the present invention relates to an exercise rug 10 that has ridges 14 woven at specific intervals in the vicinity of the upper edge 18 and lower edge 20 of the exercise rug. Thus, in the example of FIG. 1, the exercise rug 10 is 200 cm. in length from the upper edge 18 to the lower edge 20. A first set of ridges 14 are positioned about 9 cm from the upper edge 18 and lower edge 20 and a second set of ridges 14 are positioned about 9 cm from the first set of ridges 14. A third set of ridges 14 are placed about 9 cm from the second set of ridges 14. The remaining ridges 14 are spaced about 4.5 cm from the third set of ridges 14, as shown. In this manner, the ridges 14 are placed on the exercise surface 12 at locations where the ridges 14 will provide the most beneficial effect, while at the same time, providing the least degree of hindrance to the user.

In general, in the preferred embodiment, the exercise surface 12 is divided into a upper portion 19, a lower portion 21 and a central portion 22. Preferably, the contours of the invention are located only in one or both of the upper portion 19 and lower portion 21 and no contours are located in the central portion 22, to thereby provide a more comfortable exercise surface in central portion 22. Alternatively, in some embodiments it may also be desirable to locate contours in the central portion 22. The relative sizes of the upper portion 19, lower portion 21 and central portion 22 can be varied to accommodate different sized users, to fit with different shaped exercise rugs, or to accommodate different types of exercise on the rug 10. The upper portion 19 may also be larger, smaller, or equivalent in size to the lower portion 21.

In one embodiment, as shown in FIG. 1, the area of the central portion 22 is larger than the area of each of the upper portion 19 and the lower portion 21. More preferably, also as shown in FIG. 1, the area of the central portion 22 is larger than the combined area of the upper portion 19 and lower portion 21.

Figure 2:
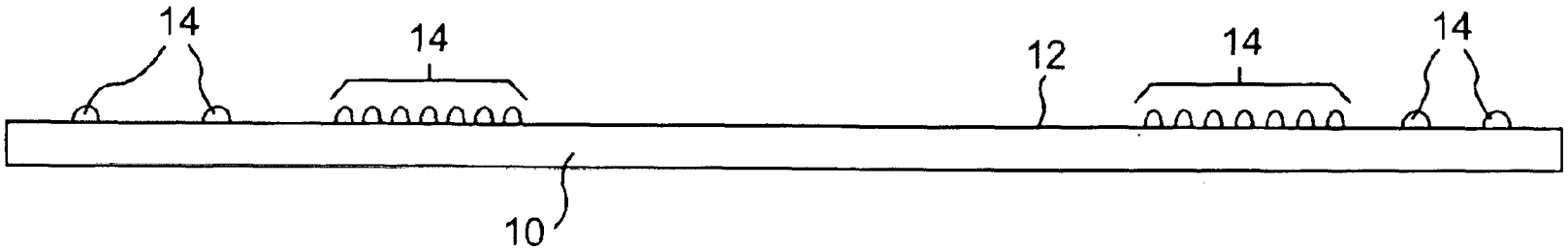
FIG. 2 is a side view of the embodiment of the exercise rug shown in FIG. 1.

Referring to FIG. 2, there is shown a side view of the rug 10 of FIG. 1 to show the contours formed by ridges 14 protruding relative to a non-contoured portion of the exercise surface 12.

Figure 3:
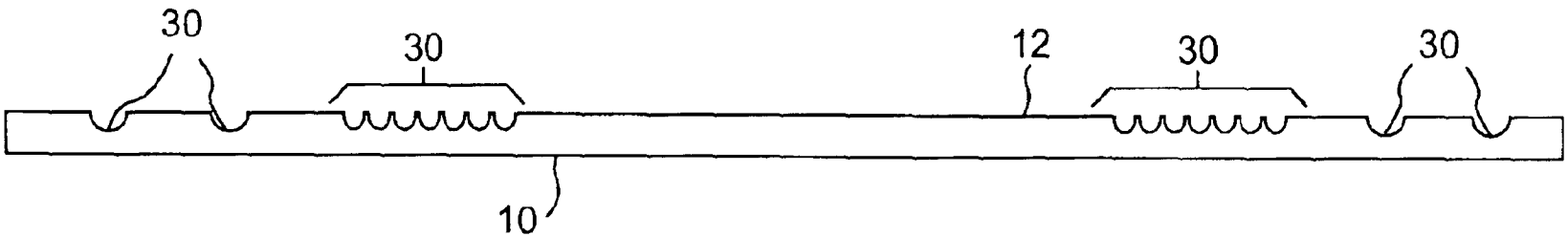
FIG. 3 is a side view of an alternative embodiment of an exercise rug in accordance with the present invention which employs indentations in the surface of the rug to provide a traction surface.

FIG. 3 shows an alternative embodiment of an exercise rug 10 in accordance with the present invention wherein the contours are formed by indentations 30 in the exercise surface 12. Indentations 30 may be of any suitable shape and are preferably concavely rounded, as shown in FIG. 3. The indentations 30 may form the same pattern in the exercise surface as the ridges 14 shown in FIG. 1, or other patterns may be employed, so long as a sufficient sized traction surface is provided by the indentations 30.

Figure 4:
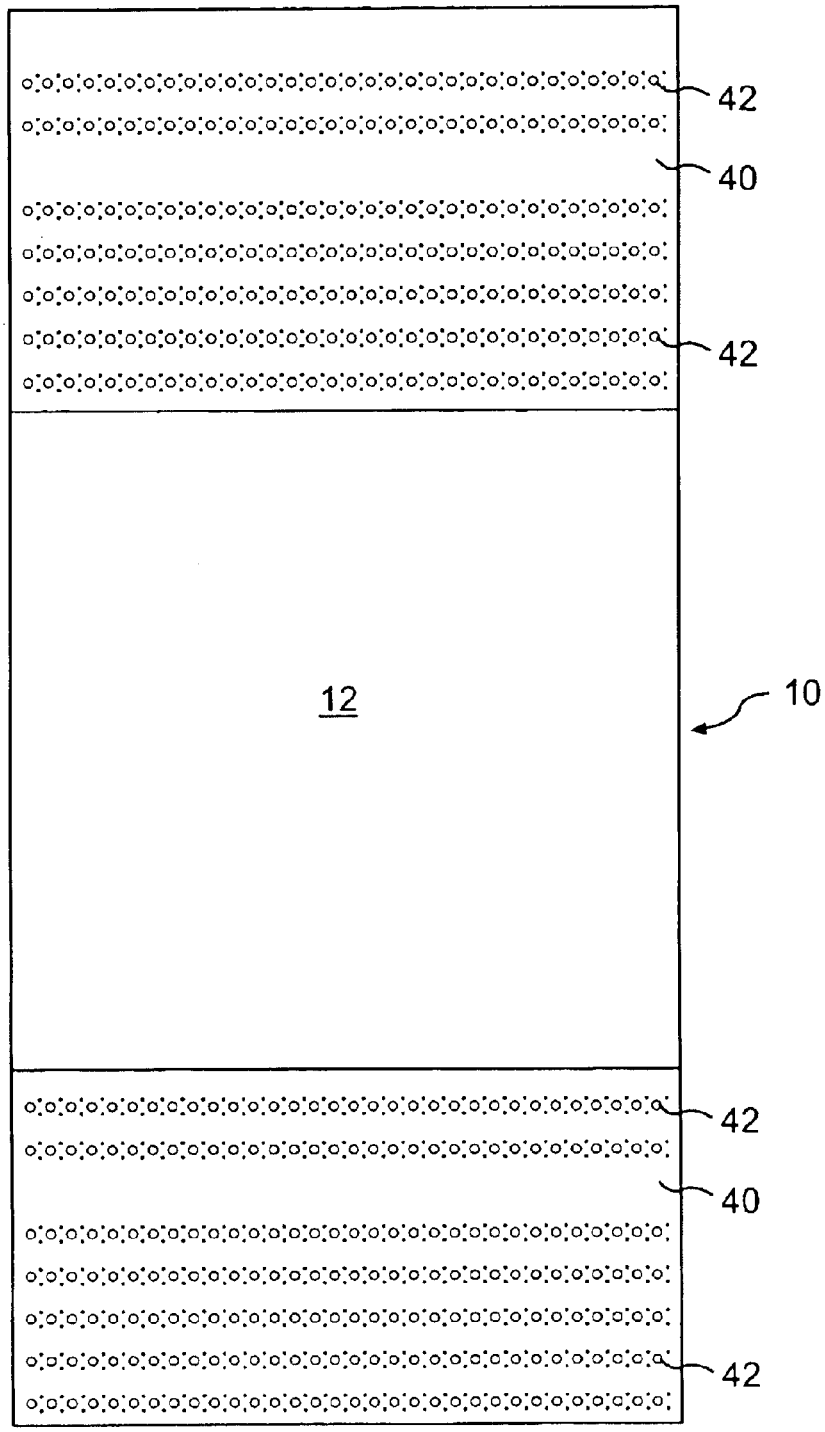
FIG. 4 is a top view of another embodiment of the invention.

FIG. 4 shows yet another alternative embodiment of an exercise rug in accordance with the present invention. In this embodiment, the contours 42 are formed by the addition of a foam rubber portion 40 to the exercise surface 12. Other, similar materials may be employed instead of foam rubber to provide the contours. Suitable materials should provide a traction surface, be firmly adhered to the rug and, preferably, absorb moisture.

The present invention has been described with reference to preferred embodiments thereof. Many modifications and variations within the scope of the invention will be apparent to a skilled person and thus the scope of the invention is to be determined by the claims appended hereto.

What is claimed is:

1. A woven exercise rug comprising:

a woven rug portion having an exercise surface, wherein said exercise surface has a first edge and a second edge, said second edge being substantially longer than said first edge;

a plurality of contours comprising a plurality of supplementary wefts creating a textured effect, located on at least a portion of the exercise surface of the woven rug portion, each said contour having a longer dimension and a shorter dimension, wherein the longer dimension of each of said contours is oriented substantially perpendicular to the second edge of said exercise surface, wherein each said contour is substantially linear and substantially parallel to each other contour in the direction of said longer dimension, and, wherein said contours are sufficient to provide a user of the exercise rug an improved grip on the contoured surface portion of the exercise surface, relative to the user's grip on a non-contoured surface portion of the exercise surface.

2. A woven exercise rug as claimed in claim 1, wherein said exercise surface of the woven rug portion includes an upper portion, a lower portion and a central portion, and said contours are located in at least one of said upper and lower portions of the exercise surface of the woven rug portion.

3. A woven exercise rug as claimed in claim 2, wherein an area of the central portion of the exercise surface of the woven rug portion is larger an area of each of the upper and lower portions of the exercise surface of the woven rug portion.

4. A woven exercise rug as claimed in claim 3, wherein the area of the central portion of the exercise surface of the woven rug portion is larger than the combined area of the upper and lower portions of the exercise surface of the woven rug portion.

5. A woven exercise rug as claimed in claim 1, wherein the contours comprise a plurality of ridges oriented substantially perpendicular to the second edge of the exercise rug.

6. A woven exercise rug as claimed in claim 1, wherein said exercise surface of the woven rug portion includes an upper portion, a lower portion and a central portion, and said contours comprise a plurality of ridges located in said upper portion of said exercise surface of the woven rug portion, and a plurality of ridge located in said lower portion of the exercise surface of the woven rug portion.

7. A woven exercise rug as claimed in claim 6, wherein the ridges are spaced at a predetermined distance from one another, and wherein the spacing between sets of ridges varies for at least two different sets of ridges.

8. A woven exercise rug as claimed in claim 7, wherein said central portion of the exercise surface of the woven rug portion is free of contours.

9. A woven exercise rug as claimed in claim 1, wherein the contours further comprise supplementary warps, and wherein said complementary warps are in addition to those required to provide structural integrity to the rug.

10. A woven exercise rug as claimed in claim 1, wherein the contours are formed by a separate layer of material attached to the exercise surface of the woven rug portion of the exercise rug.

11. A woven exercise rug as claimed in claim 10, wherein said exercise surface of the woven rug portion includes a upper portion, a lower portion and a central portion, and said rug comprises a separate layer of material attached to said upper portion of said exercise surface of the woven rug portion, and a separate layer of material attached to lower portion of the exercise surface of the woven rug portion.

12. A woven exercise rug as claimed in claim 11, wherein the contours are spaced at a predetermined distance from one another, and wherein the spacing between sets of contours varies for at least two different sets of contours.

13. A woven exercise rug as claimed in claim 1, wherein said contours are substantially uniformly spaced across a portion of said one surface the woven rug portion.

14. A woven exercise rug as claimed in claim 1, wherein said contours are substantially uniformly spaced across substantially all of said one surface of the woven rug portion.

15. A woven exercise rug as claimed in claim 1, wherein said contours are formed as bumps.

16. A woven exercise rug as claimed in claim 1, wherein said woven exercise rug is rectangular in shape.

* * * * *